US007131534B2

(12) United States Patent
Enes

(10) Patent No.: US 7,131,534 B2
(45) Date of Patent: Nov. 7, 2006

(54) GOLF BAG AND STRAP SYSTEM

(75) Inventor: Seth M. Enes, Missoula, MT (US)

(73) Assignee: Sun Mountain Sports, Inc., Missoula, MT (US)

( * ) Notice: Subject to any disclaimer, the term of this patent is extended or adjusted under 35 U.S.C. 154(b) by 245 days.

(21) Appl. No.: 10/194,157

(22) Filed: Jul. 12, 2002

(65) Prior Publication Data

Related U.S. Application Data

(60) Provisional application No. 60/306,758, filed on Jul. 19, 2001.

(51) Int. Cl.
*A63B 55/00* (2006.01)
*A45F 3/04* (2006.01)

(52) U.S. Cl. ..... 206/315.3; 224/260; 224/642; 24/579.09

(58) Field of Classification Search ..... 224/645, 224/642, 260, 627, 643; 206/315.3; 24/579.11, 24/579.09

See application file for complete search history.

(56) References Cited

U.S. PATENT DOCUMENTS

| | | | | | |
|---|---|---|---|---|---|
| 3,739,961 | A * | 6/1973 | Soukeras | 224/579 |
| 4,750,652 | A * | 6/1988 | Grant | 224/627 |
| 5,038,984 | A | 8/1991 | Izzo | 224/209 |
| 5,042,703 | A | 8/1991 | Izzo | 224/209 |
| 5,042,704 | A | 8/1991 | Izzo | 224/209 |
| 5,246,153 | A * | 9/1993 | Beletsky | 224/192 |
| 5,348,205 | A | 9/1994 | Steurer | 224/209 |
| 5,429,288 | A * | 7/1995 | Sattler | 224/258 |
| D362,752 | S * | 10/1995 | Steurer | D3/255 |
| 5,499,761 | A | 3/1996 | Reimers | 224/202 |
| 5,558,259 | A * | 9/1996 | Izzo | 224/627 |
| 5,593,077 | A | 1/1997 | Izzo | 224/627 |
| 5,636,778 | A | 6/1997 | Jones et al. | 224/627 |
| 5,775,558 | A * | 7/1998 | Montalbano | 224/627 |
| 5,810,223 | A * | 9/1998 | Helm | 224/250 |
| D411,039 | S | 6/1999 | Reimers et al. | D3/255 |
| D411,666 | S | 6/1999 | Reimers et al. | D3/327 |
| D412,396 | S | 8/1999 | Reimers et al. | D3/255 |
| 5,954,254 | A * | 9/1999 | Maeng | 224/645 |
| 5,988,475 | A * | 11/1999 | Han | 224/608 |
| 5,996,871 | A * | 12/1999 | Maeng | 224/645 |
| 6,006,974 | A * | 12/1999 | Varney et al. | 224/645 |
| 6,152,343 | A * | 11/2000 | Shin | 224/645 |
| 6,164,505 | A * | 12/2000 | Holter et al. | 224/259 |
| 6,283,350 | B1 * | 9/2001 | Gottmeier et al. | 224/639 |
| 6,328,192 | B1 * | 12/2001 | Sundara et al. | 224/645 |
| 6,460,747 | B1 * | 10/2002 | Tuerschmann et al. | 224/645 |
| 6,568,575 | B1 * | 5/2003 | Bartholomew | 224/583 |

(Continued)

*Primary Examiner*—Sue A. Weaver
(74) *Attorney, Agent, or Firm*—Michael J. Hughes; Larry B. Guernsey; Intellectual Property Law Offices

(57) ABSTRACT

A golf bag and strap system for supporting a golf bag, having a central hub including a number of arms. Each arm has at least one attachment point to which straps are connected. The arms include upper arms and lower arms, and upper straps are attached to the upper arms, and lower straps are attached to the lower arms. Each attachment point preferably includes a D-ring. The central hub also preferably includes a padded portion having a raised portion which acts as a center of rotation for movement of the central hub.

13 Claims, 3 Drawing Sheets

U.S. PATENT DOCUMENTS

2002/0088836 A1* 7/2002 Batten et al.

2002/0113105 A1* 8/2002 Jarman

* cited by examiner

GOLF BAG AND STRAP SYSTEM

This patent application claims priority from provisional application 60/306,756 filed Jul. 19, 2001 to the same inventor.

TECHNICAL FIELD

The present invention relates generally to golf bags and more particularly to strap systems for carrying golf bags.

BACKGROUND ART

Golf is a game in which obtaining exercise is one of many goals, but in which its practitioners generally like to avoid discomfort. As golf can be practiced by people of many ages and physical conditions, it is important that carrying the golf clubs around the course not be perceived as burdensome. In an effort to make carrying the bag of golf clubs as easy as possible, many types of straps have been produced to improve the comfort of the user. The first types of straps used were generally single straps that extended from the bottom or foot of the golf bag to somewhere around the top of the bag. This was of course an improvement over carrying the bag by hand, and left the user's hands free.

The dual or double strap system has several advantages over the single strap because the weight is divided between the two straps, thus causing less stress on each of the shoulders. Several US patents have been involved with this dual strap concept. Among them are U.S. Pat. Nos. 5,038,984, 5,042,703 and 5,042,704 to Izzo, U.S. Pat. No. 5,348,205 to Steurer and U.S. Pat. No. 5,636,778 to Jones. Each of these makes an attempt to improve the balance and/or weight distribution of the golf bag to improve the user of the user who is carrying the bag. Crucial considerations in the balance of the bag are the placement of the strap mounting points.

The stability of the bag as the user walks about is also of concern. A bag that bounces or swings excessively is undesirable, as this type of motion can be very tiring, as well as possibly annoying. Users of prior golf bags often are seen holding the ends of the bag to minimize motion. This of course defeats the purpose of providing the user with a "hands free" implementation.

Thus there is a need for a golf bag which is more stable, involving very little swing or bounce, which distributes the weight of the bag on the shoulders well and has improved balance.

DISCLOSURE OF INVENTION

Accordingly, it is an object of the present invention to present a golf bag and strap system which allows "hands free" operation.

Another object of the invention is to present a golf bag and strap system which has very little sway or bounce.

And another object of the invention is to present a golf bag and strap system which has improved balance and weight distribution.

A further object of the present invention is to present a golf bag and strap system which is very comfortable for the user.

An additional object of the present invention is to present a golf bag and strap system which is ergonomically designed to minimize fatigue of the user.

Briefly, one preferred embodiment of the present invention is a golf bag, and strap system for supporting a golf bag, the strap system having a central hub including a number of arms. Each arm has at least one attachment point to which straps are connected. The arms include upper arms and lower arms and upper straps are attached to the upper arms, and lower straps are attached to the lower arms. Each attachment point preferably includes a D-ring. The central hub also preferably includes a padded portion having a raised portion which acts as a center of rotation for movement of the central hub.

An advantage of the present invention is that the present golf bag and strap system is very adaptable to a large variety of users.

Another advantage of the present invention is that bounce and vibration of the golf bag is greatly minimized by using the present invention.

And another advantage of the present invention is that balance and weight distribution of the golf bag is improved by used of the present invention.

These and other objects and advantages of the present invention will become clear to those skilled in the art in view of the description of the best presently known mode of carrying out the invention and the industrial applicability of the preferred embodiment as described herein and as illustrated in the several figures of the drawings.

BEST MODE FOR CARRYING OUT THE INVENTION

Figure 1:
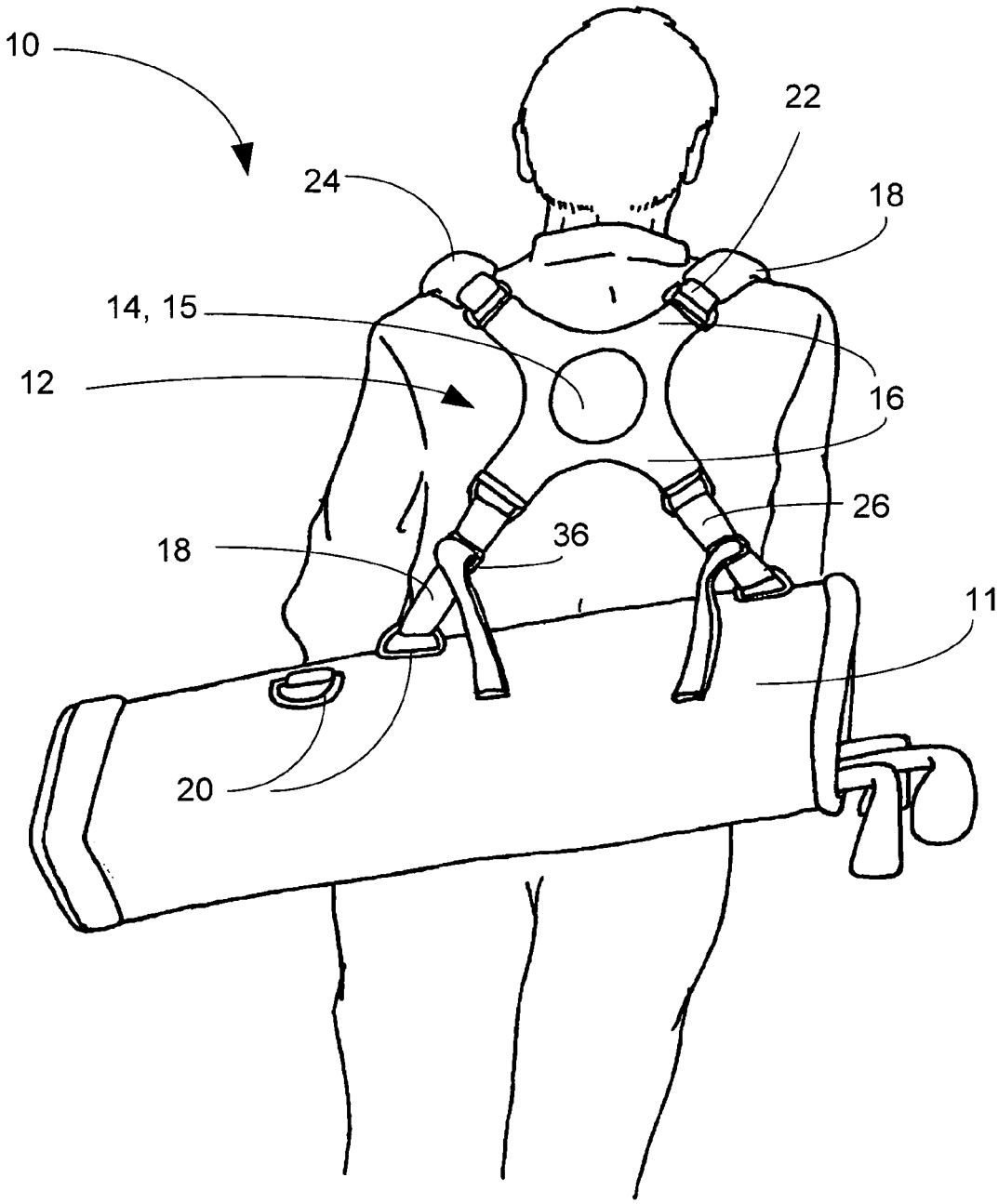
FIG. 1 shows the strap system of the present invention in use with a golf bag.

The purposes and advantages of the present invention will be apparent from the following detailed description in conjunction with the appended drawings in which:

FIG. 1 shows the golf bag 10 of the present invention in use with a strap system 12. The golf bag 10 includes an enclosure 11. The strap system 12 includes a central portion 14 which will referred to as a central hub 15 which has a number of arms 16 to which straps 18 have been attached, which in turn connect to D-rings 20 or other attachment points on the golf bag 12. These straps 18 generally include a set of upper straps 22 which include a padded portion 24 and lower straps 26, which are preferably nylon webbing with little or no padding.

Figure 2:
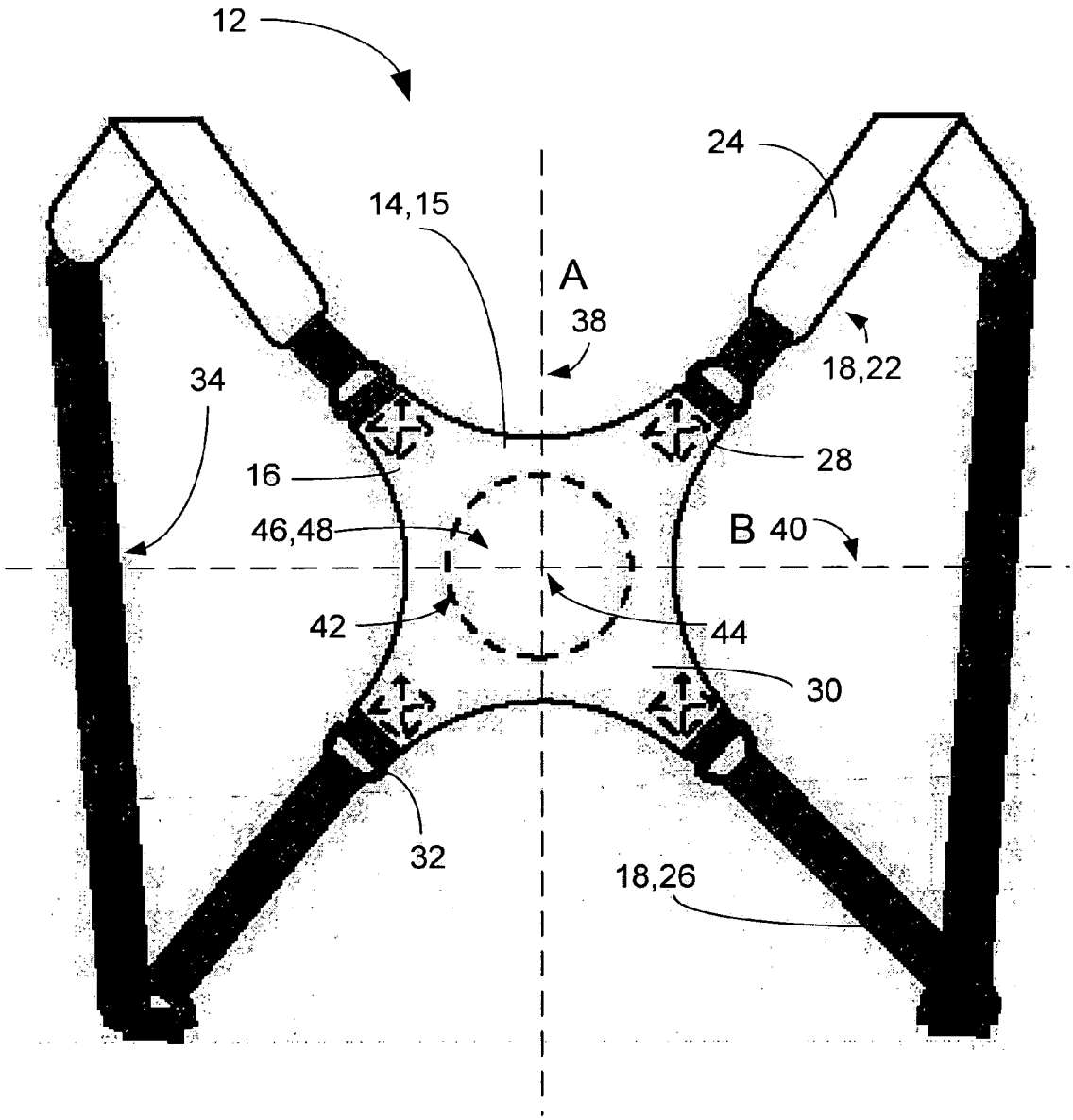
FIG. 2 illustrates a top plan view of the present strap system isolated from use with a golf bag.
Figure 3:
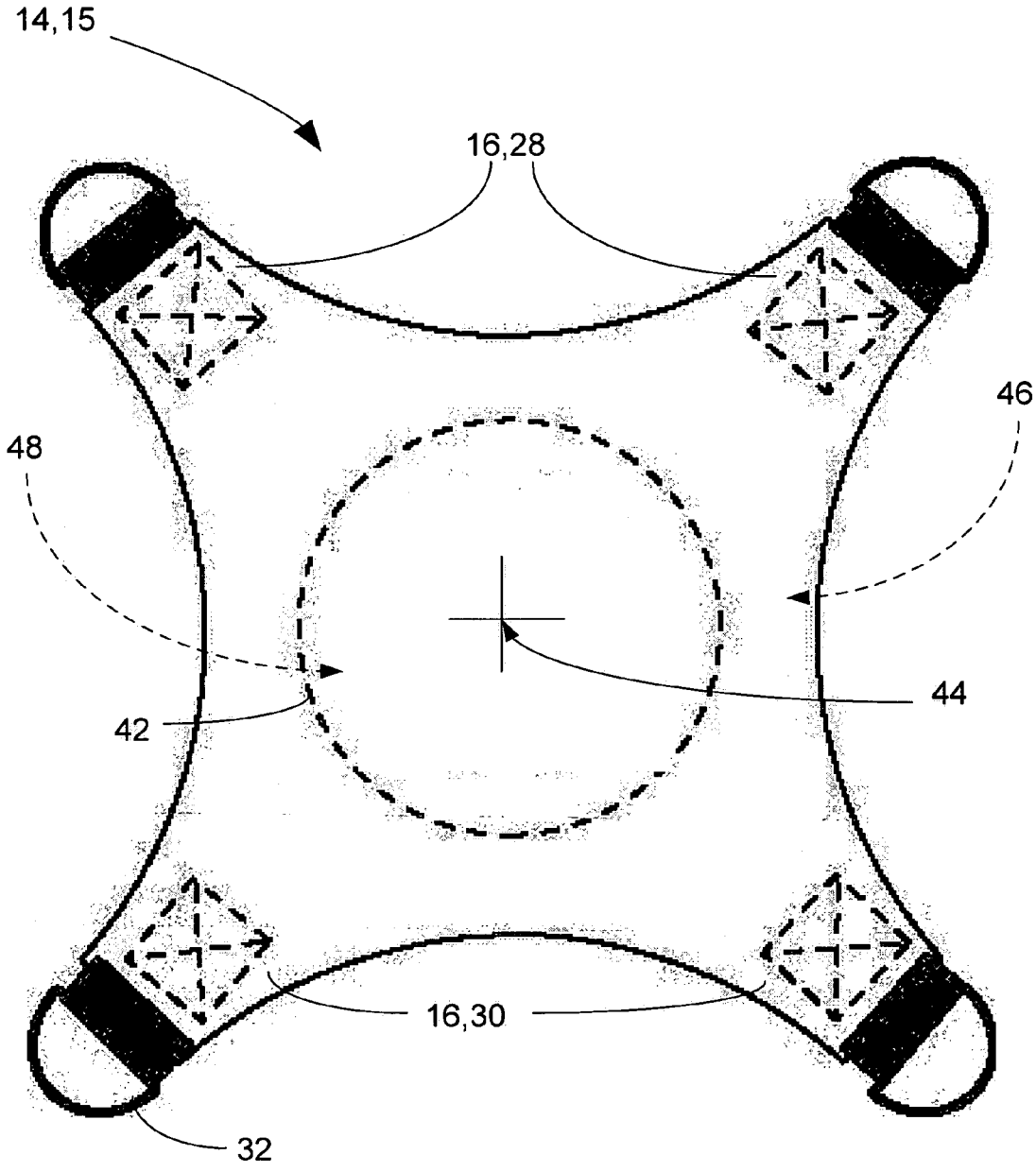
FIG. 3 shows a top plan view of the central portion of the present strap system isolated from the rest of the strap system.

FIG. 2 shows the strap system 12 in isolation from the golf bag 12. FIG. 3 shows the central portion 14 and central hub 15 further isolated from the rest of the strap system 12. Referring now to both FIGS. 2 and 3, as well as FIG. 1, the central portion 14 is shown having arms 16, which can be further divided into upper arms 28 and lower arms 30. There are preferably four arms 16, but this number is not to be construed as a limitation, and there could be fewer or a greater number of arms. Likewise, the shape of the central portion 14 is shown as being somewhat "webbed" in shape, that is, having arcuate sides which curve to form the arms 16, but this is not to be construed as a limitation. For example, the central portion 14 or central hub 15 may be configured as a square, rectangle, hexagon, circle, polygon or irregular shape, as long as it provides the appropriate balance and weight distribution. As will be discussed below, a certain symmetry may be useful in providing this balance, but it is not essential.

The arms 16 include attachment points, preferably D-rings 32, to which the upper straps 22 and lower straps 26 connect. In this figure, the upper and lower straps 22, 26 connect to make a continuous loop 34. It is also possible that the upper straps 22 and lower straps 26 be completely separate and their ends attachable to separate D-rings 20 on the bag 10. As shown in FIG. 1, the straps 22, 26 also are preferably adjustable in length, and to this end, they include a buckle 36 or sliding clip somewhere along their lengths. It is most preferred that each of the four upper and lower straps 22, 26 be independently adjustable to allow the best balance for the bag 10.

As shown in FIG. 2, the central hub 15 can be divided along either vertical axis A 38 or horizontal axis B 40. As referred to above, the central hub 15 may be advantageously configured to be symmetrical about the vertical axis A 38 or the horizontal axis B 40. It is currently preferred that the lower arms 30 are slightly longer than the upper arms 28, but this is not to be construed as a limitation.

An advantage of the current strap system 12 is its stability. The central hub 15 tends to rotate in response to shifts in balance, rather than having independent straps which slide past each other, or which slide separately. The central hub 15 also contacts the middle of the user's back, and thus tends to oppose small movements by frictional force, and dampens vibrations as well. The result is a more stable feeling, in which there is reduced bouncing or swinging of the bag, and thus, much more comfort for the user.

The central hub 15 also optionally includes a stitched design 42, which in this case is a circle, but which could again be almost any regular or irregular geometric shape. The underside (not visible) of the central hub 15 also preferably includes a padded portion 46 for the comfort of the user. Besides being decorative, the stitching 42 can isolate a raised portion 48 of this padded underside, which helps to isolate it as a point of contact for the user. This also helps to configure it as a center of rotation 44 for the central hub 15. An additional feature that adds to the stability of the strap system 12 is that the connection points of the upper straps 22 and lower straps 26 are set at a (radial) distance from this center of rotation 44, thus making effectively a larger rotational object, which is less prone to bouncing and vibration.

The golf bag 10 itself is preferably configured with attachment points that work well with the present strap system 12. As shown in FIG. 1, this may include a series of D-rings 20 which may be spaced to accommodate body sizes and shapes. The inventor has determined that this strap system is very adaptable for all body sizes and types but works especially well for people of small to medium stature.

While various embodiments have been described above, it should be understood that they have been presented by way of example only, and not limitation.

INDUSTRIAL APPLICABILITY

The present strap system 12 is well suited for carrying a user's golf bag 10 with a minimum of vibration and discomfort.

Golf is practiced by people of many ages and physical conditions, and it is important that carrying the golf clubs around the course not be perceived as burdensome. In an effort to make carrying the bag of golf clubs as easy as possible, a dual or double strap system has been developed, which has several advantages over the single strap because the weight is divided between the two straps, thus causing less stress on each of the shoulders. Crucial considerations in the balance of the bag are the placement of the strap mounting points. The stability of the bag as the user walks about is also of concern. A bag that bounces or swings excessively is undesirable, as this type of motion can be very tiring, as well as possibly annoying.

In answer to these concerns, the strap system 12 of the present invention includes a central portion 14 or central hub 15 which has a number of arms 16 to which straps 18 have been attached which in turn connect to D-rings 20 or other attachment points on the golf bag 10. These straps 18 generally include a set of upper straps 22 which include a padded portion 24 and lower straps 26, which are preferably nylon webbing with little or no padding. The central hub 15 also preferably includes a stitched design 42, and includes a padded portion 46 for the comfort of the user. Besides being decorative, the stitching 42 can isolate a raised portion 48 of this padded underside, which helps to isolate it as a point of contact for the user. This also helps to configure it as a center of rotation 44 for the central hub 15. An additional feature adds to the stability of the strap system 12 is that the connection points of the upper straps 22 and lower straps 26 are set at a (radial) distance from this center of rotation 44, thus making effectively a larger rotational object, which is less prone to bouncing and vibration.

The strap system 12 of the present invention has very little sway or bounce, and has improved balance and weight distribution. The golf bag 10 with strap system 12 is ergonomically designed to minimize fatigue of the user and is very comfortable for the user. The balance and weight distribution of the golf bag 10 is improved by used of the present invention. Additionally, it is very adaptable to a large variety of users, and allows improved "hands free" operation.

For the above, and other, reasons, it is expected that the golf bag 10 with strap system 12 of the present invention will have widespread industrial applicability. Therefore, it is expected that the commercial utility of the present invention will be extensive and long lasting.

I claim:

1. A central hub for a golf bag strap system, comprising:

a symmetrical central portion having four arms extending radially therefrom for attachment to ends of respective golf bag straps;

a D-ring situated at the end of each said arm, providing pivotal connection between said arm and the respective end of said golf bag strap; wherein the pivotal connection of the central hub to said golf bag straps permits rotation of the hub on the back of a golfer when carrying the golf bag, providing continually adjusting balance optimization during use.

2. The central hub of claim 1, wherein:

said central hub includes a padded portion.

3. The central hub of claim 2, wherein:

said padded portion includes a raised portion.

4. The central hub of claim 3, wherein:

said raised portion acts as a center of rotation for movement of said central hub.

5. A strap system for supporting a golf bag, comprising:

a plurality of straps, each strap having a first end and a second, said second end being attached to an attachment point on said golf bag; and a central hub having a plurality of arms, each arm having at least one attachment point to which said first end of at least one of said plurality of straps is pivotally connected, said central hub including a padded portion which includes a raised portion.

6. The strap system of claim 5, wherein:

said raised portion acts as a center of rotation for movement of said central hub.

7. The strap system of claim 5, in which said plurality of arms are integrally formed as a part of said hub.

8. A strap system for supporting a golf bag, comprising:

a plurality of straps including a set of two upper straps each having a padded portion which engages the shoulder region of a user and a set of two lower straps connecting to the golf bag; and a central hub having four symmetrical arms, each said arm having at least one attachment point to which one of said plurality of straps is pivotally connected, wherein said central hub rotates during use in response to forces applied on each of said straps to provide optimized balance of the golf bag as carried on the shoulders of the user.

9. A golf bag having attachment points with strap support system comprising:

an enclosure for holding and organizing golf clubs; and a strap system for supporting said golf bag, said strap system including a plurality of straps, each strap having a first end and a second end, said second end being attached to an attachment point on said golf bag;

and a central hub having a plurality of arms, each arm having at least one attachment point to which said first end of at least one of said plurality of straps is pivotally connected, wherein said central hub includes a padded portion having a raised portion.

10. The golf bag of claim 9, wherein:

said raised portion acts as a center of rotation for movement of said central hub.

11. The golf bag of claim 9, in which said plurality of arms are integrally formed as a part of said hub.

12. The golf bag of claim 9, in which said plurality of straps includes a set of upper straps and a set of lower straps, said upper straps each having a padded portion which engages the shoulder region of a user, and said lower straps which attach between said attachment points of said central hub and said golf bag.

13. A golf bag with strap support system comprising:

an enclosure for holding and organizing golf clubs; and a strap system for supporting said golf bag, said strap system including a central hub having four symmetrically arrayed radial arms integrally formed as a part of said hub, each said arm having a pivotal attachment point to which straps are connected, such that said hub pivots during use to provide optimum balance in response to forces applied to said straps.

* * * * *